United States Patent [19]

Barnard et al.

[11] 4,233,701

[45] Nov. 18, 1980

[54] NAPPED BEDDING BLANKET

[75] Inventors: Ralph G. Barnard; Judson D. Taylor, Jr., both of Eden, N.C.

[73] Assignee: Fieldcrest Mills, Inc., Eden, N.C.

[21] Appl. No.: 739,598

[22] Filed: Nov. 8, 1976

[51] Int. Cl.[3] ..... A47G 9/00

[52] U.S. Cl. ..... 5/482; 5/499

[58] Field of Search ..... 5/334 R; 26/15 R, 29 R; 428/91

[56] References Cited

U.S. PATENT DOCUMENTS

| | | | |
|---|---|---|---|
| 449,620 | 3/1891 | Greene | 26/15 R |
| 1,672,781 | 6/1928 | Richardson | 26/15 R |
| 2,115,581 | 4/1938 | Johnson | 428/91 |
| 2,271,281 | 1/1942 | Whitman | 5/334 R |
| 2,305,526 | 12/1942 | Hadley | 26/29 R |
| 3,635,785 | 1/1972 | Hughes | 428/91 |

*Primary Examiner*—Peter M. Caun

*Attorney, Agent, or Firm*—Bell, Seltzer, Park & Gibson

[57] ABSTRACT

A napped bedding blanket having an enhanced hand and a more uniform surface appearance and which substantially avoids the problem of shedding and pilling without chemical treatment or mechanical locking and thereby is able to substantially maintain its initial surface appearance during normal usage and after laundering. The blanket has a nap of uniformly distributed raised fibers on at least one side of a fibrous substrate, with the fibers extending generally outwardly from the substrate a uniform distance to provide a planar surface on the nap. The blanket is produced by subjecting a nappable substrate to a napping operation to raise fibers from the substrate and form a nap, and thereafter shearing the nap to a level such that substantially all of the raised fibers are sheared.

8 Claims, 3 Drawing Figures

NAPPED BEDDING BLANKET

Figure 1:
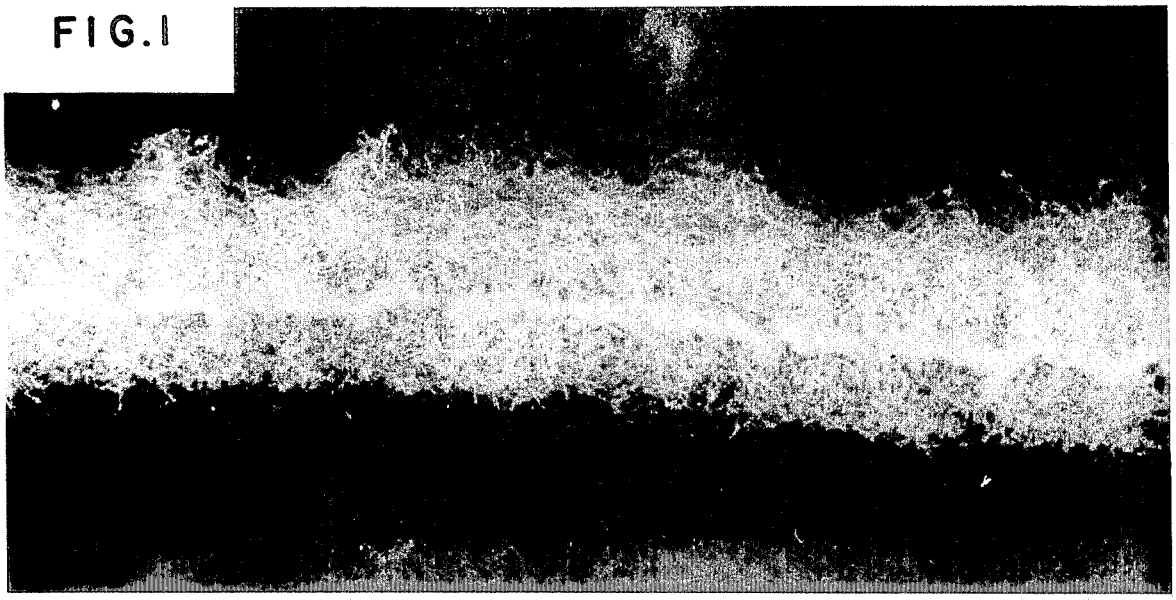

The present invention relates to a napped bedding blanket having a unique napped fiber construction which substantially avoids the problem of shedding and pilling without chemical treatment or mechanical locking, and which is thereby able to substantially maintain its initial surface appearance after extended usage and repeated launderings.

Napped bedding blankets are conventionally manufactured by a process wherein a woven or non-woven fabric substrate is passed over a large cylinder having a number of small napping rollers positioned about its periphery. The small rollers are covered with wire card clothing, with the wire points thereof contacting the substrate to raise a substantial number of fibers from the substrate to form a thick, felt-like pile surface. Typically, the napping operation is carried out on both sides of the substrate to produce a pile surface on both sides of the resulting blanket.

A persistent problem associated with conventional napped bedding blankets produced in the above manner resides in the fact that the raised fibers in the napped pile surface tend to shed and pill after the blanket has been in use, thereby severely detracting from the appearance of the fabric. More particularly, the napped surface includes a number of raised fibers which extend outwardly beyond the majority of the raised fibers to form a low density outer portion of uneven surface appearance. The loose ends of these outermost raised fibers tend to collect in clusters on the surface of the fabric and ball up into unsightly fluffs, particularly after the fabric has been used and laundered.

Several fabric treatment operations have heretofore been proposed in an attempt to overcome the shedding and pilling problem, but without appreciable success. In one such prior proposal, the napped fabric is subjected to a roller treatment which serves to tuck or bend the raised fibers back into the substrate of the fabric. Thus, the roller treatment attempts to mechanically lock the raised fibers in the substrate, but it also tends to undesirably reduce the loft of the napped surface. In addition, only a limited degree of improvement has been achieved by this procedure since the fibers tend to loosen and return to their original position.

Another commonly employed process of reducing the shedding and pilling problem involves the use of a chemical treatment, and wherein a chemical is applied to the surface of the napped fabric and then dried in an attempt to bond the raised fibers together. While this process is presently being commercially utilized subsequent to a mechanical locking treatment, it is not altogether satisfactory since the presence of the chemical treatment tends to stiffen the napped surface and thus reduces the hand and drapability of the fabric. Further, normal laundering tends to remove the effect of the bonding chemical, such that in time, the effectiveness of the treatment may be substantially lost.

From the above, it will be apparent that prior approaches to a solution of the shedding and pilling problem have been directed to attempts to lock the raised fibers together by one means or another, so as to prevent their tendency to collect and ball up on the surface. The present invention however departs completely from this approach, and is directed to a totally unique concept which not only overcomes the above noted disadvantages associated with the previously proposed attempts at a solution, but also achieves vastly superior results. More particularly, it has been discovered that the shedding and pilling problem may be effectively eliminated by shearing the surface of the napped fabric to thereby provide a substantially planar sheared surface on the nap which is substantially devoid of clusters of undesirably long raised fibers. In this regard, the shearing operation of the present invention involves not only the severance of those few fibers which extend well beyond the body of the underlying more dense nap, but it also includes the outermost portion of such underlying more dense nap. Thus substantially all of the raised fibers in the resulting fabric are sheared and extend to a uniform height.

Shearing operations have heretofore been employed in association with napped fabrics for the purpose of achieving a relatively smooth uniform surface. However, in such prior shearing operations, it was thought desirable to remove the smallest possible fiber height, since the removal of an excessive amount of the fiber would result in an undue loss of bulk. Thus, so far as can be determined, it was the prior practice to sever only those few fibers which extended well beyond the body of the underlying more dense nap. In the present invention however, a substantially greater portion of the napped fiber height is removed than was the practice in the prior shearing operations, and surprisingly, it was discovered that this additional removal of the outermost portions of the underlying more dense nap results in a napped product which substantially eliminates the shedding and pilling problem.

It is accordingly an object of the present invention to provide a napped bedding blanket and method of fabricating the same wherein the blanket maintains its initial surface appearance after extended usage and repeated launderings.

It is another object of the present invention to provide a napped bedding blanket and method of fabricating the same which effectively resists shedding and pilling, and without compaction or stiffening of the fabric by mechanical or chemical treatments.

These and other objects and advantages of the present invention are achieved in the embodiments illustrated herein by the provision of a napped bedding blanket which comprises a fibrous substrate, a nap on at least one side of the substrate formed of raised substrate fibers, and with the raised fibers being uniformly distributed throughout the nap and extending generally outwardly away from the substrate. Substantially all of the raised fibers are sheared and extend a uniform distance from the substrate to provide a substantially planar surface on the nap substantially devoid of clusters of undesirably long raised fibers along the surface of the nap. The blanket is formed by a process which includes shearing the nap and removing the outer lower density portions thereof and the outermost portions of the underlying more dense nap, such that substantially all of the raised fibers are sheared.

Figure 2:
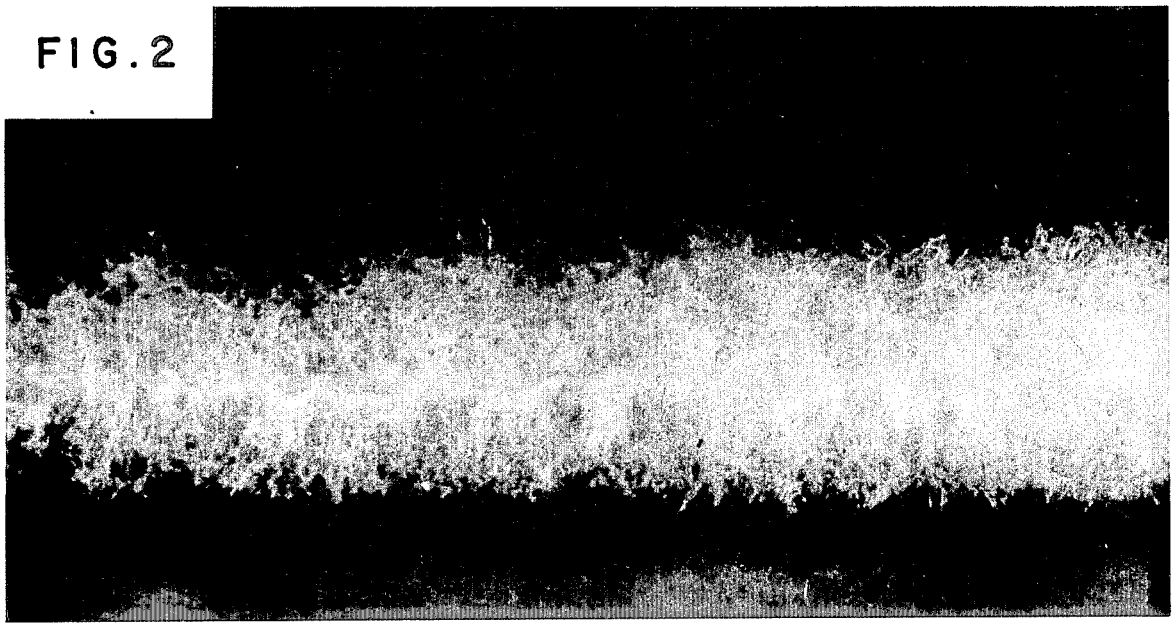
Figure 3:
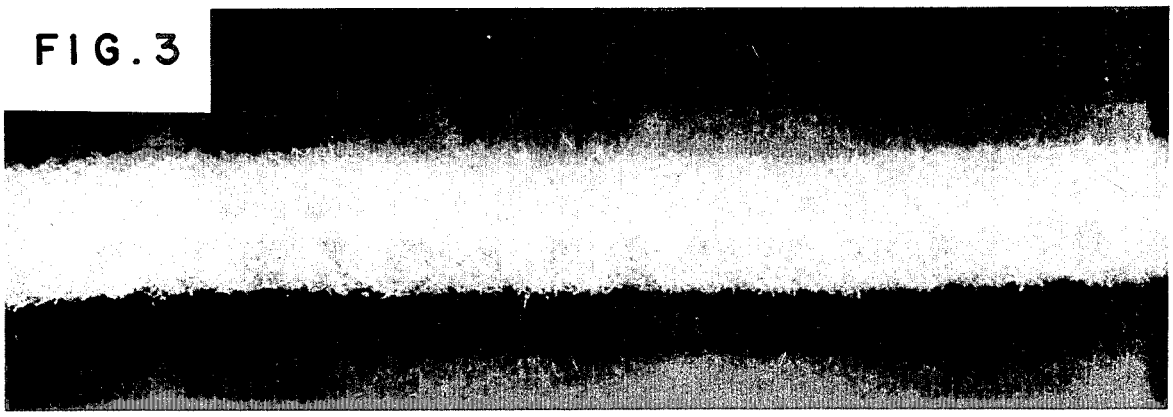

Some of the objects of the invention having been stated, other objects will appear as the description proceeds when taken in connection with the accompanying drawings, in which FIG. 1 is a photomicrograph showing a magnified cross section of a conventional napped bedding blanket fabric and which has been chemically treated to reduce shedding and pilling in accordance with the prior art;

FIG. 2 is a photomicrograph on a scale corresponding to that of FIG. 1 and showing a cross section of a napped bedding blanket fabric, and wherein the upper surface is non-sheared and the lower surface has been sheared in accordance with the present invention; and FIG. 3 is a photomicrograph on a scale corresponding to that of the other figures and showing a cross section of a napped bedding blanket fabric in accordance with the present invention, and wherein both of the surfaces of the fabric have been sheared.

Referring more specifically to the drawings, FIG. 1 discloses a woven napped bedding blanket in accordance with the conventional prior art practices noted above. As will be apparent, the napped fibers are generally uniformly distributed throughout the nap and extend outwardly from the substrate to form a thick pile surface. Also, the napped surface includes a number of raised fibers which extend outwardly beyond the majority of the raised fibers to form a low density outer portion of uneven surface appearance. The loose ends of these outermost raised fibers are, in several areas, collected in clusters on the surface of the fabric and within the low density outer portion.

Viewing FIG. 2, it will be apparent that the upper non-sheared surface closely resembles the two surfaces of the fabric shown in FIG. 1. The lower surface however has been subjected to a shearing operation wherein the outermost raised fibers have been removed, and in addition, the outermost portion of the underlying more dense nap is also removed. Thus, substantially all of the raised fibers in the nap are sheared and extend to a uniform height.

Both surfaces of the napped fabric illustrated in FIG. 3 have been sheared in accordance with the present invention, and as will be apparent, a slightly closer shearing operation has been employed than in the case of the lower surface of the fabric in FIG. 2, and such that slightly more of the underlying more dense portion of the nap of the fabric in FIG. 3 has been removed.

While the invention in terms of the nap surface is applicable to both woven and non-woven substrate, preferably, the substrate from which the napped bedding blanket of the present invention is fabricated is a single or double woven fabric wherein both the warp and filling yarns are formed of spun staple fibers. To facilitate the raising of dense nap, the filling yarns are preferably larger and of lower twist than the warp yarns, such that the majority of the nap is raised from the filling yarns.

To further enhance the density of the raised nap, it is desirable to weave the substrate to an initial width which is wider than conventional, for example, 81 inches versus 76 inches in the case of a blanket having a finished width of 66 inches. As is well known, substantial widthwise shrinkage occurs after wet processing, such as piece dyeing which occurs prior to napping, and the resulting width is less than the desired finished width. The substrate is then stretched on a tenter frame to return to the desired width. As will be apparent, substantially less stretching is required in the case of the present invention, in view of the increased initial width of the substrate. Also, the increased initial width results in a greater density of the filling yarns in the substrate, which serves to substantially increase the density of the nap.

To produce the napped bedding blanket of the present invention, a substrate as described above is passed through a conventional napping machine at least once, and preferably a plurality of times, to repeatedly raise fibers from each side of the substrate to form a nap of uniform density thereon. In this regard it is generally preferred that the fabric be napped to a greater extent than in the case of conventional napped blanket fabrics to thereby form a nap of raised fibers which is of sufficiently high density to provide lateral and vertical support to adjacent fibers thereof.

The above napped product is then sheared, without having been subjected to a prior tucking operation or chemical treatment of the type described above. The shearing operation may be conducted on a conventional shearing machine, and the height of the shear is adjusted so that the outer lower density portion of the nap is removed, as well as the outermost portion of the underlying more dense nap and as illustrated in FIGS. 2 and 3. Typically, this shearing operation results in a weight loss of between about 7 to 15%. The resulting bedding blankets of this invention may have a weight of about 4.5 to 13 ounces per square yard and a thickness within the range of about 0.17 to 0.35 inches.

While the exact fabric construction whether woven or non-woven may vary depending upon the characteristics of the desired final product, the following example describes a napped blanket fabric construction which has been found particularly suitable for a normal weight bedding blanket:

CONSTRUCTION OF SUBSTRATE FABRIC

| | Greige | Finished |
|---|---|---|
| Ends per inch | 27.9 | 32.5 |
| Picks per inch | 34 | 34.9 |
| Yarn No. (Warp) | 16/1 | — |
| Yarn No. (Filling) | 3/1 | — |
| Fiber Content | 100% acrylic | |
| Weave | 2 × 2 broken twill | |

The example substrate fabric is subjected to 3 to 5 passes through a napping machine to raise a dense nap on each side of the substrate. The resulting fabric is sheared on both sides with the shear set at a height to provide a shearing loss of about 9% by weight. The resulting product has a thickness within the range of about 0.17 to 0.22 inches, and a weight of about 9.5 ounces per square yard.

In the drawings and specification, there has been set forth a preferred embodiment of the invention, and although specific terms are employed, they are used in a generic and descriptive sense only and not for purposes of limitation.

That which is claimed is:

1. A napped bedding blanket having an enhanced hand and a more uniform surface appearance substantially devoid of clusters of undesirably long raised fibers, said blanket being characterized by substantially maintaining its initial surface appearance during normal usage and after laundering and by a resistance to shedding and pilling without reliance upon any stabilizing chemical treatment, said blanket comprising a fibrous substrate, a nap on at least one side of said substrate formed of raised substrate fibers shielding the substrate from view, the raised fibers of said nap being relatively uniformly distributed throughout the nap and extending generally outwardly away from the substrate, and with substantially all of the raised fibers being sheared and extending a uniform distance from the substrate to provide a substantially planar surface on the nap substantially devoid of clusters of undesirably long raised fibers along the surface of the nap.

2. A napped bedding blanket having an enhanced hand and a more uniform surface appearance substantially devoid of clusters of undesirably long raised fibers, said blanket being characterized by substantially maintaining its initial surface appearance during normal usage and after laundering and by a resistance to shedding and pilling without reliance upon any stabilizing chemical treatment, said blanket comprising a fibrous substrate formed of yarns of spun staple fibers, a nap on at least one side of said substrate formed of raised fibers of the substrate yarns shielding the substrate from view, the raised fibers of said nap being substantially uniformly distributed throughout the nap and having one end secured to a substrate yarn with portions thereof extending generally outwardly therefrom, and with substantially all of the raised fibers being sheared and extending a substantially uniform distance from the substrate to provide a substantially planar sheared surface which is devoid of clusters of undesirably long raised fibers on the surface of the nap.

3. A napped bedding blanket according to claim 2 having a weight of about 4.5 to 13 ounces per square yard and thickness not exceeding about 0.35 inch.

4. A napped bedding blanket having an enhanced hand and a more uniform surface appearance substantially devoid of clusters of undesirably long raised fibers, said blanket being characterized by substantially maintaining its initial appearance during normal usage and after laundering and by a resistance to shedding and pilling without reliance upon any stabilizing chemical treatment, said blanket comprising a fibrous substrate formed of interwoven warp and weft yarns of spun staple fibers, the weft yarns being larger and of lower twist than the warp yarns, a nap on each of the opposing sides of the substrate and being formed of raised fibers of the substrate yarns shielding the substrate from view, the raised fibers of each of said naps being substantially uniformly distributed throughout the nap and being of a density to provide lateral and vertical support to adjacent fibers thereof, and the raised fibers extending generally outwardly away from the substrate and with substantially all of the raised fibers being sheared and extending a substantially uniform distance from the substrate to provide substantially planar respective surfaces on said naps substantially devoid of clusters of undesirably long raised fibers along the surfaces of the naps.

5. A method of making a napped bedding blanket having an enhanced hand and a more uniform surface appearance substantially devoid of undesirably long raised fibers, said blanket being characterized by substantially maintaining its initial surface appearance during normal usage and after laundering and by a resistance to shedding and pilling without reliance upon any stabilizing chemical treatment, said method comprising, providing a nappable substrate formed of fibrous material, passing the substrate through a napping machine to raise fibers from at least one side of the substrate and form a nap of raised fibers protruding outwardly from the substrate and wherein a substantial number of the raised fibers extend into outer portions of the nap and provide a lower density and uneven surface appearance to outer portions of the nap, and shearing the nap and removing the outer lower density portions thereof and outermost portions of the underlying more dense nap to thereby provide a substantially uniform density of fibers in the nap shielding the substrate from view and a substantially planar sheared surface on the nap substantially devoid of clusters of undesirably long raised fibers along the surface of the nap.

6. A method according to claim 5 wherein the substrate is passed through the napping machine successively a plurality of times to raise fibers from the substrate and form a relatively high density nap of raised fibers with the fibers being oriented in a substantially erect condition extending outwardly away from the substrate.

7. A method according to claim 5 wherein the shearing of the nap produces a weight loss of about 7 to 15 percent.

8. A method of making a napped bedding blanket having an enhanced hand and a more uniform surface appearance substantially devoid of undesirably long raised fibers, said blanket being characterized by substantially maintaining its initial surface appearance during normal usage and after laundering and by a resistance to shedding and pilling without reliance upon any stabilizing chemical treatment, said method comprising providing a fibrous substrate formed of interwoven warp and weft yarns of spun staple fibers, raising fibers of the substrate yarns on each of the opposing sides of the substrate and orienting the raised fibers in a substantially erect condition to form respective naps with terminal end portions of the fibers extending generally outwardly away from the substrate and wherein a substantial number of the raised fibers extend into outer portions of the respective naps beyond the majority of the raised fibers and provide a lower density and uneven surface appearance to outer portions of the nap, and shearing the nap on each of the opposing sides of the substrate and removing the outer lower density portions thereof and outermost portions of the underlying more dense nap to thereby provide a substantially uniform density of fibers in the respective naps shielding the substrate from view and substantially planar respective sheared surfaces on the naps substantially devoid of clusters of undesirably long raised fibers along the respective surfaces of the naps.

* * * * *